US010039950B2

(12) United States Patent
Hao

(10) Patent No.: US 10,039,950 B2
(45) Date of Patent: Aug. 7, 2018

(54) MULTI-FUNCTION TRAINER

(71) Applicant: Dyaco International Inc., Taipei (TW)

(72) Inventor: Kuo-Wo Hao, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 15/266,818

(22) Filed: Sep. 15, 2016

(65) Prior Publication Data

US 2018/0036580 A1 Feb. 8, 2018

(30) Foreign Application Priority Data

Aug. 3, 2016 (TW) ..... 105124690 A

(51) Int. Cl.
*A63B 21/02* (2006.01)
*A63B 21/00* (2006.01)
*A63B 23/12* (2006.01)

(52) U.S. Cl.
CPC .... *A63B 21/4035* (2015.10); *A63B 21/00043* (2013.01); *A63B 21/023* (2013.01); *A63B 23/12* (2013.01); *A63B 23/1209* (2013.01)

(58) Field of Classification Search
CPC .... A63B 21/4035; A63B 21/023; A63B 23/12
See application file for complete search history.

(56) References Cited

U.S. PATENT DOCUMENTS 3,396,967 A * 8/1968 Brown ..... A63B 21/0455 482/128
3,451,675 A * 6/1969 Burzenski ..... A63B 21/00043 403/229
4,856,776 A * 8/1989 Ching-Liang ..... A63B 21/045 482/122
5,690,598 A * 11/1997 Liang ..... A63B 23/14 482/121
5,941,799 A * 8/1999 Bergdorf ..... A63B 23/14 482/126
8,777,821 B2 * 7/2014 Lando ..... A63B 21/023 482/121
D770,578 S * 11/2016 Chang ..... A63B 22/20 D21/691
2008/0051271 A1 * 2/2008 Mandell ..... A63B 21/00043 482/122

OTHER PUBLICATIONS

Metal vs Plastic; website:https://www.appliancedesign.com/articles/93227-metal-vs-plastic published: Aug. 2, 2012 retrieved: Jan. 18, 2018.*

* cited by examiner

*Primary Examiner* — Loan H Thanh
*Assistant Examiner* — Megan Anderson
(74) *Attorney, Agent, or Firm* — Donald E. Stout; Stout, Uxa & Buyan, LLP

(57) ABSTRACT

A multi-function trainer is provided with a spring assembly and two handle assemblies respectively arranged at a left side and a right side of the spring assembly. The spring assembly includes a spring, and each handle assembly comprises a threaded part and a fitting part. The threaded part includes a shell, and a room is within the shell. The shell includes thread and the thread includes one or more cuttings. The thread can be screwed into one end of the spring. The fitting part is placed into the threaded part.

10 Claims, 12 Drawing Sheets

MULTI-FUNCTION TRAINER

CROSS-REFERENCE TO RELATED APPLICATIONS

The entire contents of Taiwan Patent Application No. 105124690, filed on Aug. 3, 2016, from which this application claims priority, are expressly incorporated herein by reference.

BACKGROUND OF THE INVENTION

1. Field of the Invention

The present invention relates to a multifunction trainer.

2. Description of Related Art

A power bender is a device for training forearms. Typically a bower bender includes a shelled spring and two handles for being held by an operator, and the two handles are respectively arranged at the left side and the right side of the shelled spring.

The conventional method to assemble the spring and one of the two handles is firstly to put an iron tube into an end of the spring, where the outer diameter of the iron tube is greater than the internal diameter of the spring. After that, an end of the iron tube is plugged with a lock nut. A screw is then screwed with the lock nut. And finally the screw is screwed with one of the two handles.

Because the operation of the power bender frequently needs bending and shocking, the iron tube easily detaches from the spring. Some manufacturers weld the iron tube with the spring to keep them fixed. However, the spring may become fragile after the thermal welding process.

SUMMARY OF THE INVENTION

In one general aspect, the present invention relates to a multifunction trainer.

According to an embodiment of the present invention, a multifunction trainer is provided with a spring assembly and two handle assemblies. The spring assembly comprises a spring. The two handle assemblies are respectively arranged at a left side and a right side of the spring assembly, and each handle assembly comprise a threaded part and a fitting part. The threaded part has a shell and a room within the shell. A surface of the shell includes a thread with one or more longitudinal cuttings. The thread is used to be screwed into one end of the spring. The fitting part is used to be placed into the room of shell of the threaded part.

In an embodiment, the fitting part has a cylinder configuration.

In an embodiment, each handle assembly further comprises a base tube and a handle, a bottom end of the threaded part couples with a front end of the base tube, and the base tube is arranged within the handle.

In an embodiment, the fitting part has a square column configuration.

In an embodiment, each handle assembly further comprises a base tube and a handle, the fitting part passes through a square hole of the base tube, and the base tube is arranged within the handle.

In an embodiment, each handle assembly further comprises two big rollers respectively arranged at a left side and a right side of the handle, and two connecting plates are respectively arranged at a left side and a right side of each big roller, and wherein the fitting part passes through a square hole of each connecting plate and passes through a square hole of an inner tube of each big roller.

In an embodiment, the threaded part is made of plastics or rubber.

In an embodiment, an outer diameter of the thread of the threaded part is equal to or greater than an internal diameter of the spring.

In an embodiment, the fitting part is made of metal.

In an embodiment, the thread of the threaded part further includes a stop protrusion to stop the thread to be screwed into the spring.

DETAILED DESCRIPTION OF THE PREFERRED EMBODIMENT

Figure 1:
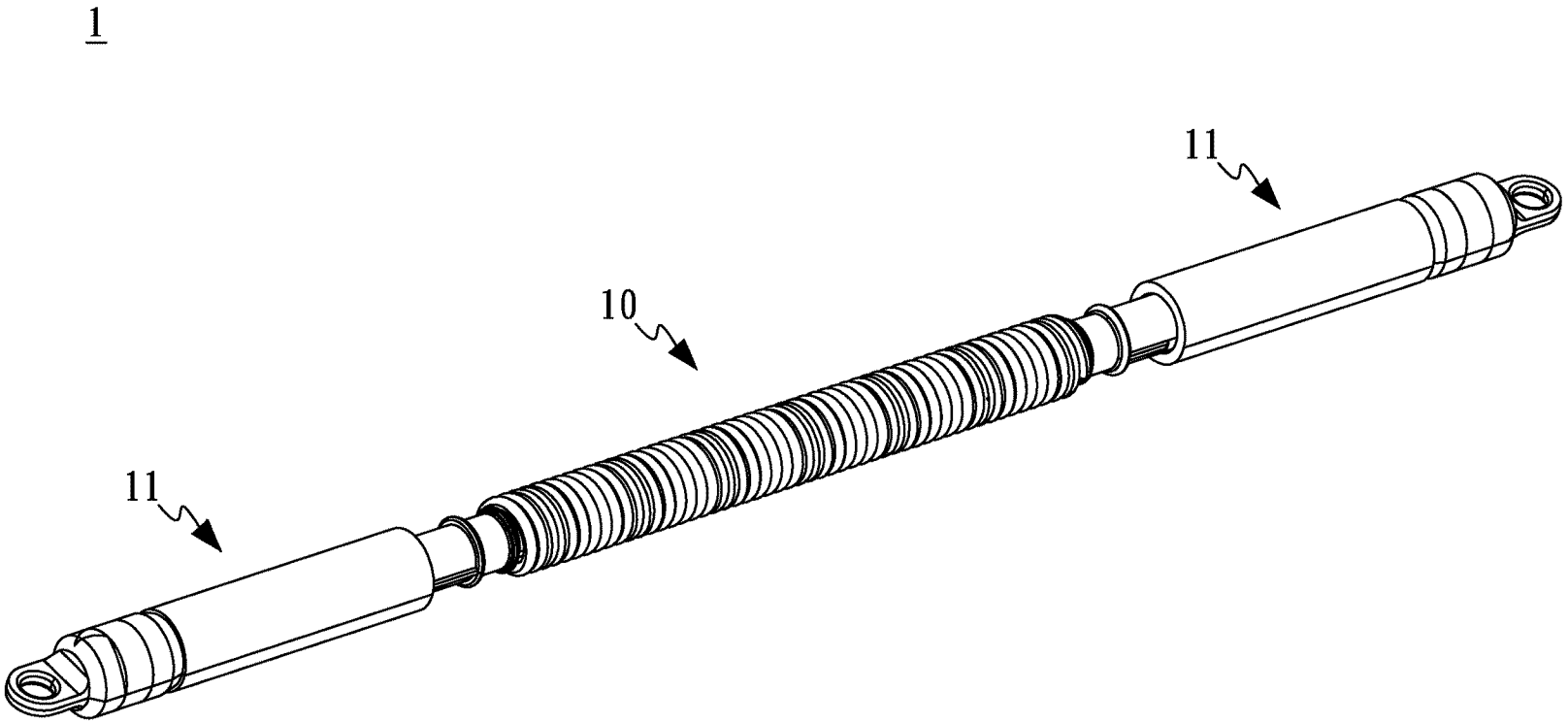
FIG. 1 is a perspective view showing a multifunction trainer according to a first embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1 is a perspective view showing a multifunction trainer 1 according to a first embodiment of the present invention. The multifunction trainer 1 includes a spring assembly 10 and two handle assemblies 11. The two handle assemblies 11 are respectively coupled with a left end and a right end of the spring assembly 10.

Figure 2:
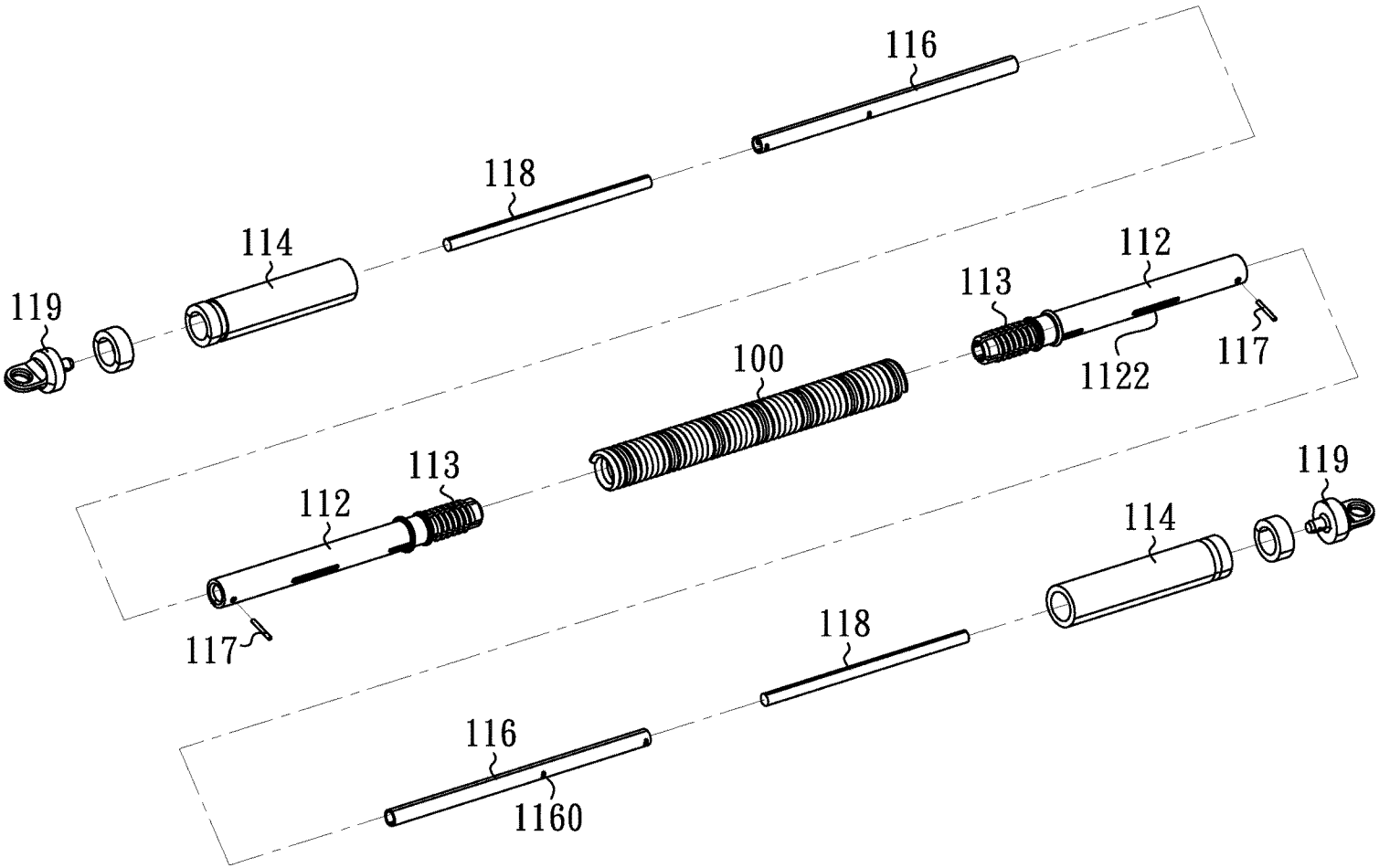
FIG. 2 is an exploded view showing a multifunction trainer according to the first embodiment of the present invention.

FIG. 2 is an exploded view showing the multifunction trainer 1 according to the first embodiment of the present invention. Referring to FIG. 2, each handle assembly 11 comprises, but is not limited to, a base tube 112, a threaded part 113, a handle 114, a fitting part 116, a weighting tube 118, and a hook 119. The spring assembly 10 comprises spring 100. In some embodiments of the present invention, one or more the above-mentioned parts may be omitted or substituted in an equivalent manner. Or, the multifunction trainer 1 may further include other parts.

Figure 3:
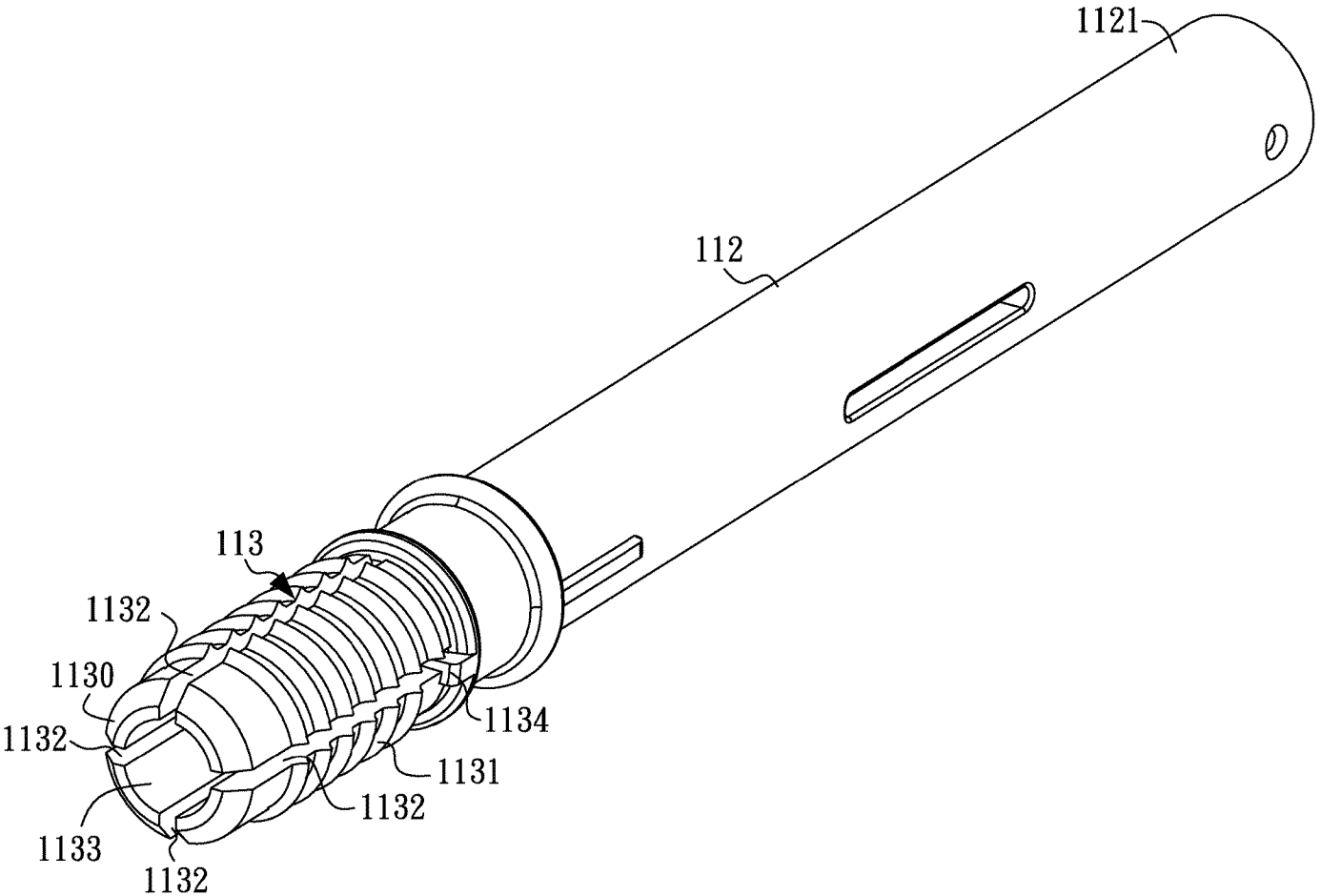
FIG. 3 is a perspective view showing a threaded part and a base tube of the multifunction trainer according to the first embodiment of the present invention.

FIG. 3 is a perspective view showing the threaded part 113 and the base tube 112 of the multifunction trainer 1 according to the first embodiment of the present invention. Referring to FIG. 3, the front end of the base tube 112 couples the bottom of the threaded part 113. The base tube 112 may have a hollowed cylinder configuration. The threaded part 113 includes a shell 1130, and a room 1133 is within the shell 1130. The surface of the shell 1130 includes thread 1131, and the thread 1131 includes one or more longitudinal cuttings 1132. In this embodiment, the number of the longitudinal cuttings 1132 is four, but it can be other numbers in other embodiments of the present invention.

Figure 4:
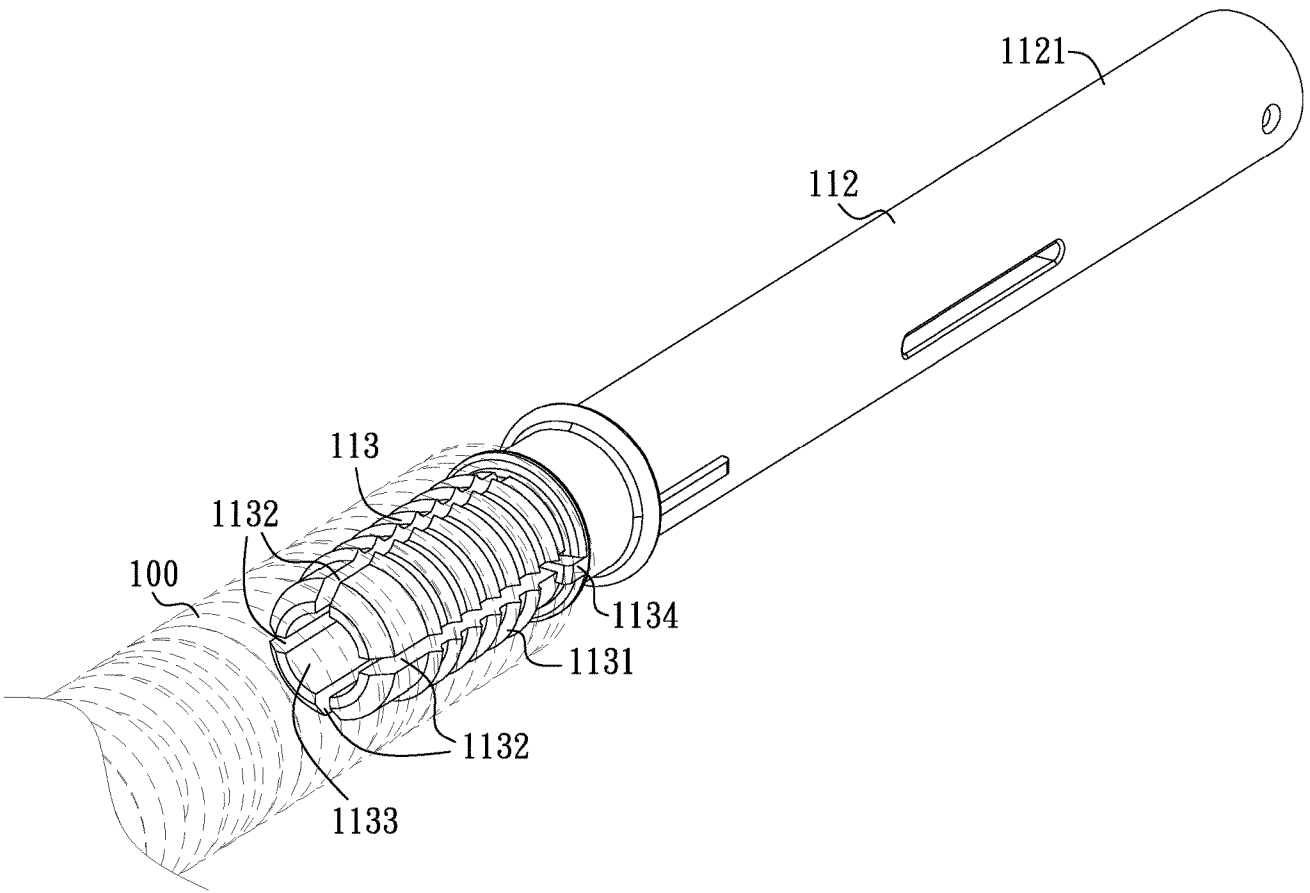
FIG. 4 is a partially enlarged view showing the assembly of parts the multifunction trainer according to the first embodiment of the present invention.

FIG. 4 is a partially enlarged view showing the assembly of the spring 100, the base tube 112, and the threaded part 113 of the multifunction trainer 1 according to the first embodiment of the present invention. Referring to FIG. 4, the thread 1131 of the thread part 113 can be screwed into one end of the spring 100. The thread part 113 preferably includes stop protrusion 1134, and when the thread 1131 of the threaded part 113 is screwed into one end of the spring 100 and the spring 100 contacts the stop protrusion 1134, the thread 1131 of the threaded part 113 will be stopped and cannot be screwed further.

Referring to FIG. 4, the outer diameter of the threaded part 113 becomes compressible (variable) due to the one or more longitudinal cuttings 1132; therefore, the threaded part 113 can be screwed into or out of the spring 100. In this embodiment, the outer diameter of the thread 1131 of the threaded part 113 can be equal to or slightly greater than the internal diameter of the spring 100. Preferably, the threaded part 113 can be made of plastics (polymer). In another embodiment of this invention, the threaded part 113 is made of rubber.

Figure 5:
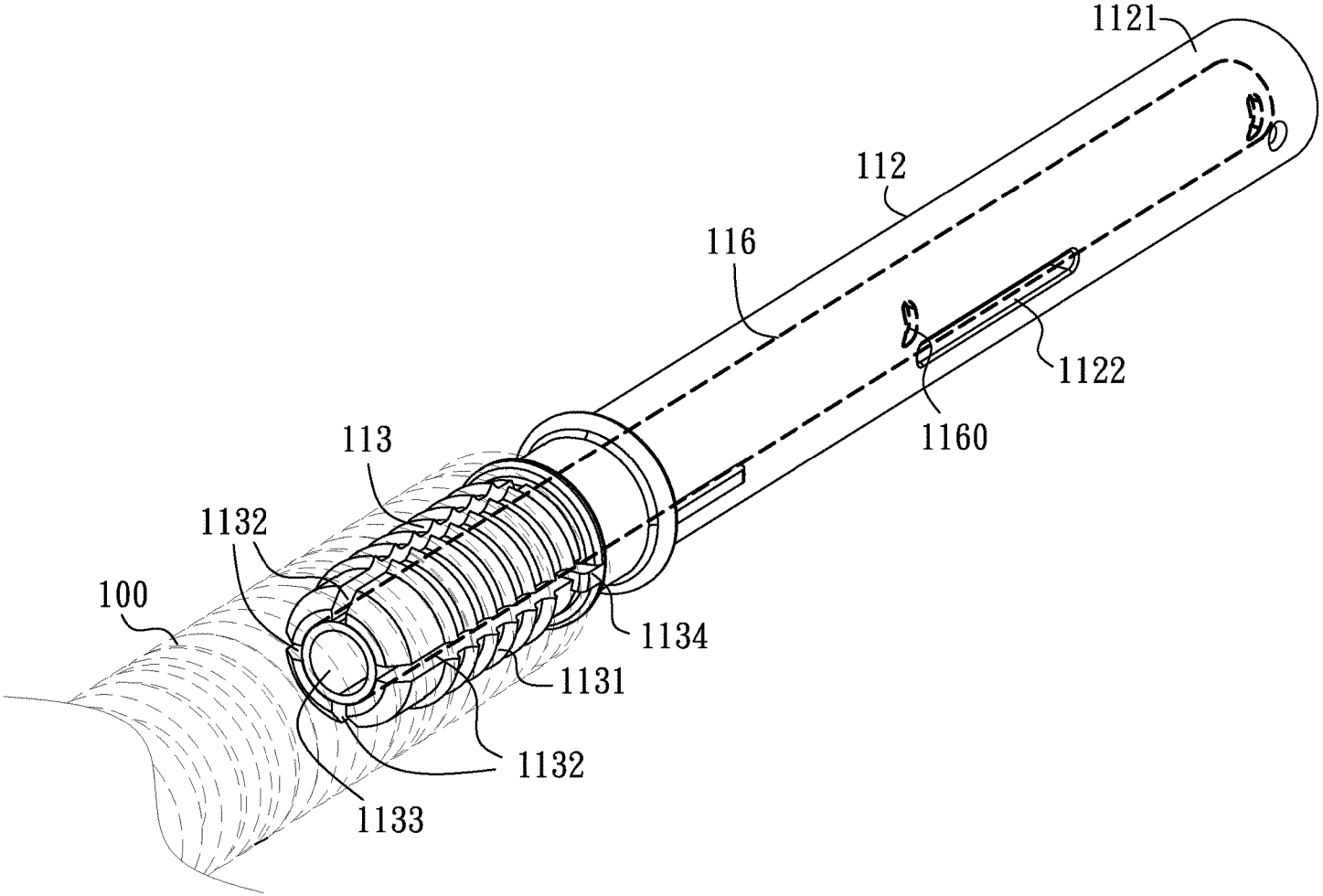
FIG. 5 is a partially enlarged view showing the assembly of parts the multifunction trainer according to the first embodiment of the present invention.

FIG. 5 is a partially enlarged view showing the assembly of spring 100, the base tube 112, and the threaded part 113 of the multifunction trainer 1 according to the first embodiment of the present invention. Referring to FIG. 5, the thread 1131 of the threaded part 113 is screwed into one end of the spring 100 and the thread 1131 is stopped by the stop protrusion 1134 when the spring 100 contacts the stop protrusion 1134. After that, a fitting part 116 is inserted into the room 1133 of the thread part 113 through the inlet 1121 of the base tube 112, and the fitting part 116 can make the cuttings 1132 to be fully spread.

In this embodiment, referring to FIG. 2 and FIG. 5, the fitting part 116 is hollowed, and a weighting tube 118 is inserted within the fitting part 116 after the fitting part 116 is inserted into the room 1133 of the threaded part 113. In another embodiment of this invention, the fitting part 116 is solid, and the weighting tube 118 is omitted. In this embodiment, the fitting part 116 and the weight tube 118 is made of metal.

Referring to FIG. 5, an important feature of the present invention is that after the fitting part 116 is inserted into the room 1133 of the threaded part 113 to spread the cuttings 1132, the outer diameter of the thread 1131 of the threaded part 113 becomes uncompressible and fixed such that the threaded part 113 cannot be screwed out from the spring 100. At this time, if a force is exerted to screw the thread 1131 of the threaded part 113 in a direction out of the spring 100, then the internal diameter of the spring 100 will become smaller than the original internal diameter of the spring 100 due to a counter torque force of the spring 100, such that the thread 1131 of the threaded part 113 is tightly engaged by the spring 100 and therefore the threaded part 113 cannot be screwed out of the spring 100.

Referring to FIG. 5, if the threaded part 113 is needed to be moved out of the spring 100, a special tool (not shown) is inserted into a slot 1122 of the base tube 112 and then clips a hole 1160 of the fitting part 116, so that the fitting part 116 can be drawn out of the room 1133 through the inlet 1121 of the base tube 112. After the fitting part 112 is moved out of the room 1133, the outer diameter of the thread 1131 of the threaded part 113 becomes compressible again such that the threaded part 113 can be screwed out of the spring 100.

Figure 6:
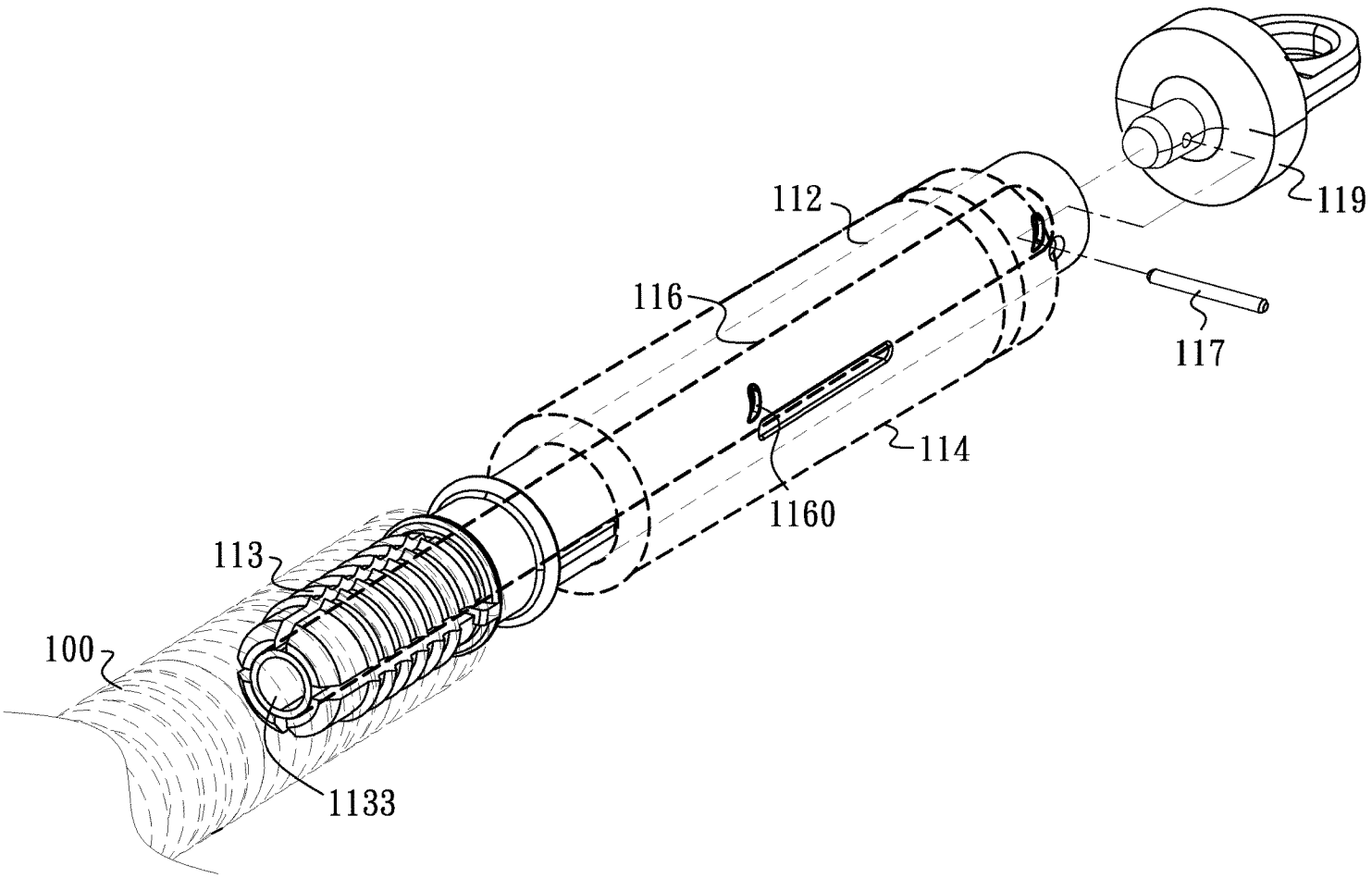
FIG. 6 is a partially enlarged view showing the assembly of parts the multifunction trainer according to the first embodiment of the present invention.

FIG. 6 is a partially enlarged view showing the assembly of parts the multifunction trainer 1 according to the first embodiment of the present invention. Referring to FIG. 2 and FIG. 6, after the fitting part 116 is inserted into the threaded part 113, the handle 114 is mounted with the base tube 112. After that, a fixing component 117 is used to fix the hook 119, the base tube 112, and the fitting part 116. In this embodiment, the fixing component 117 is a C-shaped plug, and each of the hook 119, the base tube 112, and the fitting part 116 has corresponding holes for fixing with the fixing component 117.

Figure 7:
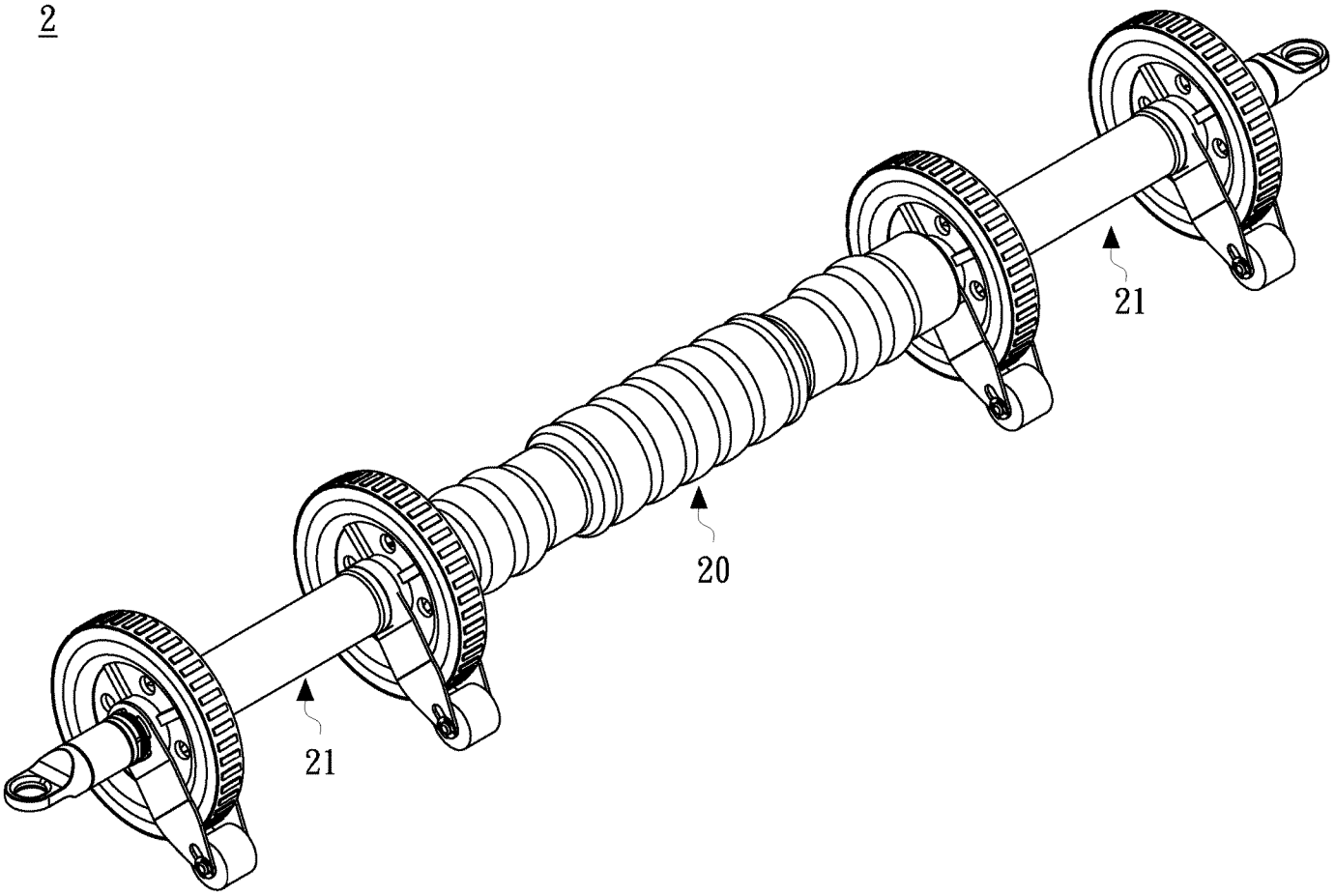
FIG. 7 is a perspective view showing a multifunction trainer according to a second embodiment of the present invention.

FIG. 7 is a perspective view showing a multifunction trainer 2 according to a second embodiment of the present invention. The multifunction trainer 2 includes a spring assembly 20 and two handle assemblies 21. The two handle assemblies 21 are respectively coupled with a left end and a right end of the spring assembly 20.

Figure 8:
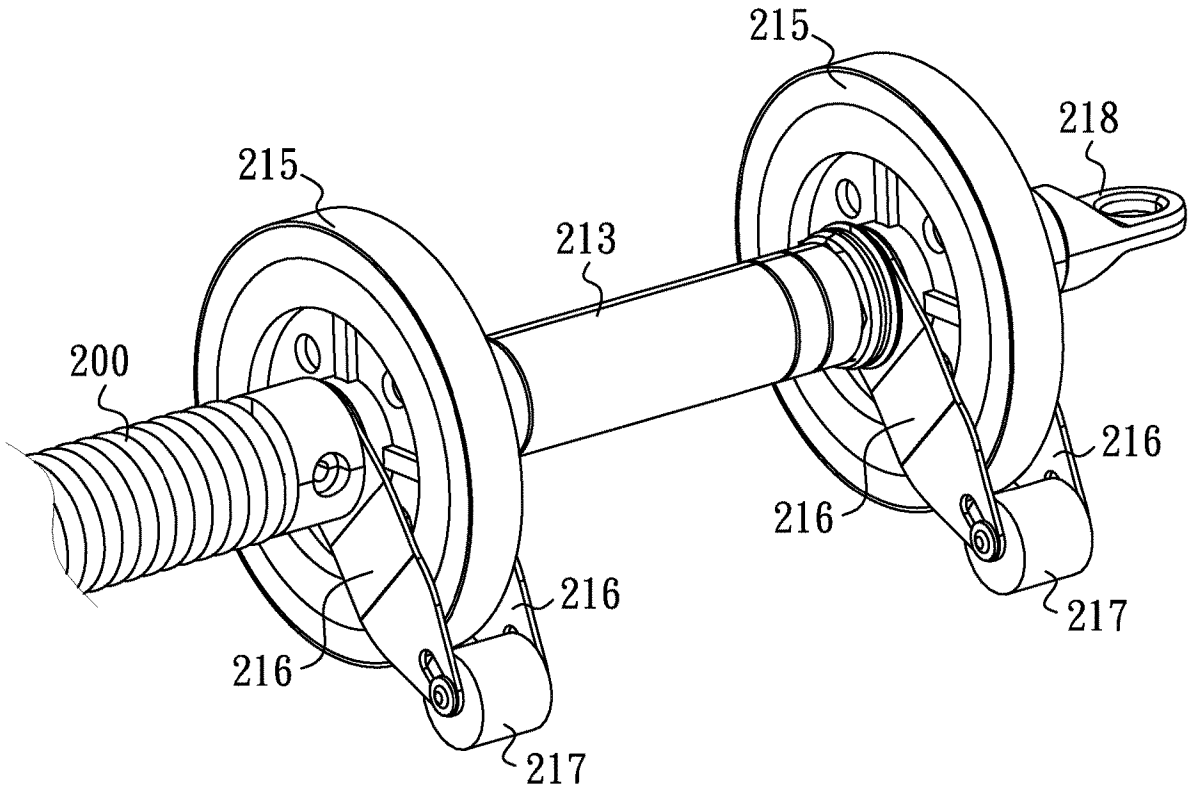
FIG. 8 is a partially enlarged view showing the multifunction trainer according to the second embodiment of the present invention.
Figure 9:
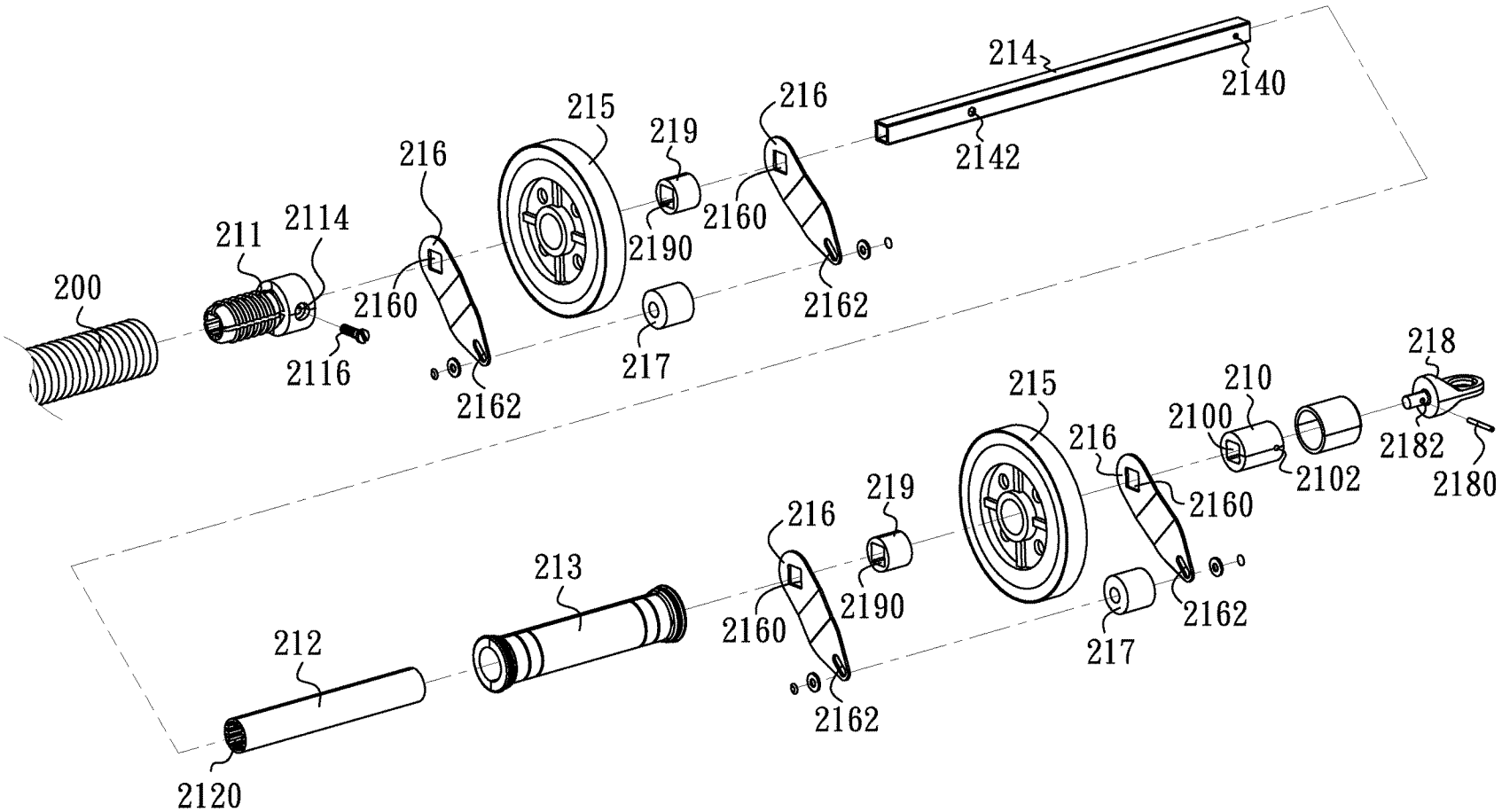
FIG. 9 is an exploded view of FIG. 8.

FIG. 8 is a partially enlarged view showing a half of the multifunction trainer 2 according to the second embodiment of the present invention, and FIG. 9 is an exploded view of FIG. 8.

Referring to FIGS. 7, 8, and 9, each handle assembly 21 comprises, but is not limited to, a threaded part 211, a base tube 212, a handle 213, a fitting part 214, two big rollers 215, four connecting plates 216, and two small rollers 217, a hook 218, an inner tune 219, and a terminal tube 210. The spring assembly 20 comprises spring 200. In some embodiments of the present invention, one or more the above-mentioned parts may be omitted or substituted in an equivalent manner. Or, the multifunction trainer 2 may further include other parts.

Figure 10:
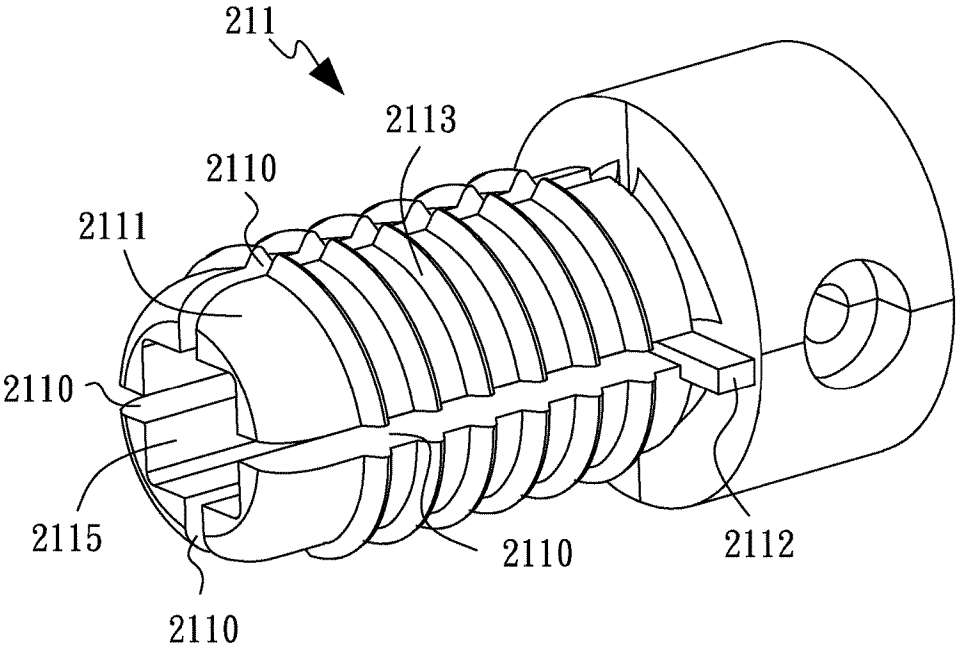
FIG. 10 is a perspective view showing a threaded part of the multifunction trainer according to the second embodiment of the present invention.

FIG. 10 is a perspective view showing the threaded part 211 of the multifunction trainer 2 according to the second embodiment of the present invention. Referring to FIG. 10, the threaded part 211 includes a shell 2111, and a room 2115 is within the shell 2111. The surface of the shell 2111 includes thread 2113, and the thread 2113 includes one or more longitudinal cuttings 2110. In this embodiment, the number of the cuttings 2110 is four, but it can be other numbers in other embodiments of the present invention.

Figure 11:
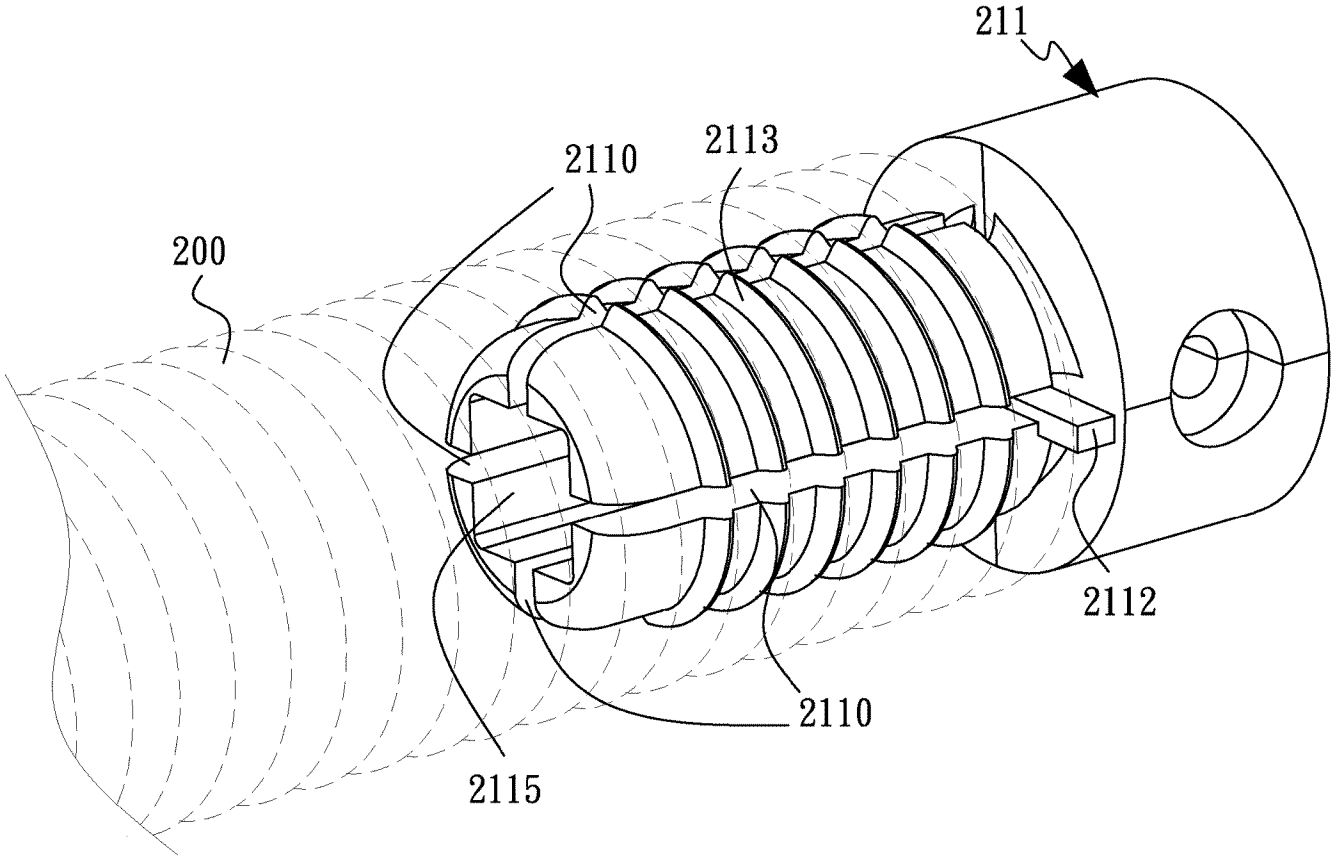
FIG. 11 is a partially enlarged view showing the assembly of parts the multifunction trainer according to the second embodiment of the present invention.

FIG. 11 is a partially enlarged view showing the assembly of the spring 200 and the threaded part 211 of the multifunction trainer 2 according to the second embodiment of the present invention. Referring to FIG. 11, the thread 2113 of the thread part 211 can be screwed into one end of the spring 200. The thread part 211 preferably includes stop protrusion 2112, and when the thread 2113 of the threaded part 211 is screwed into one end of the spring 200 and the spring 200 contacts the stop protrusion 2112, the thread 2113 of the threaded part 211 will be stopped and cannot be screwed further.

Referring to FIG. 11, the outer diameter of thread 2113 of the threaded part 211 becomes compressible due to the one or more longitudinal cuttings 2110; therefore, the thread 2113 of the threaded part 211 can be screwed into or out of the spring 200. Preferably, the threaded part 211 can be made of plastics (polymer). In another embodiment of this invention, the threaded part 211 is made of rubber. In this embodiment, the room 2115 has a square column configuration.

Figure 12:
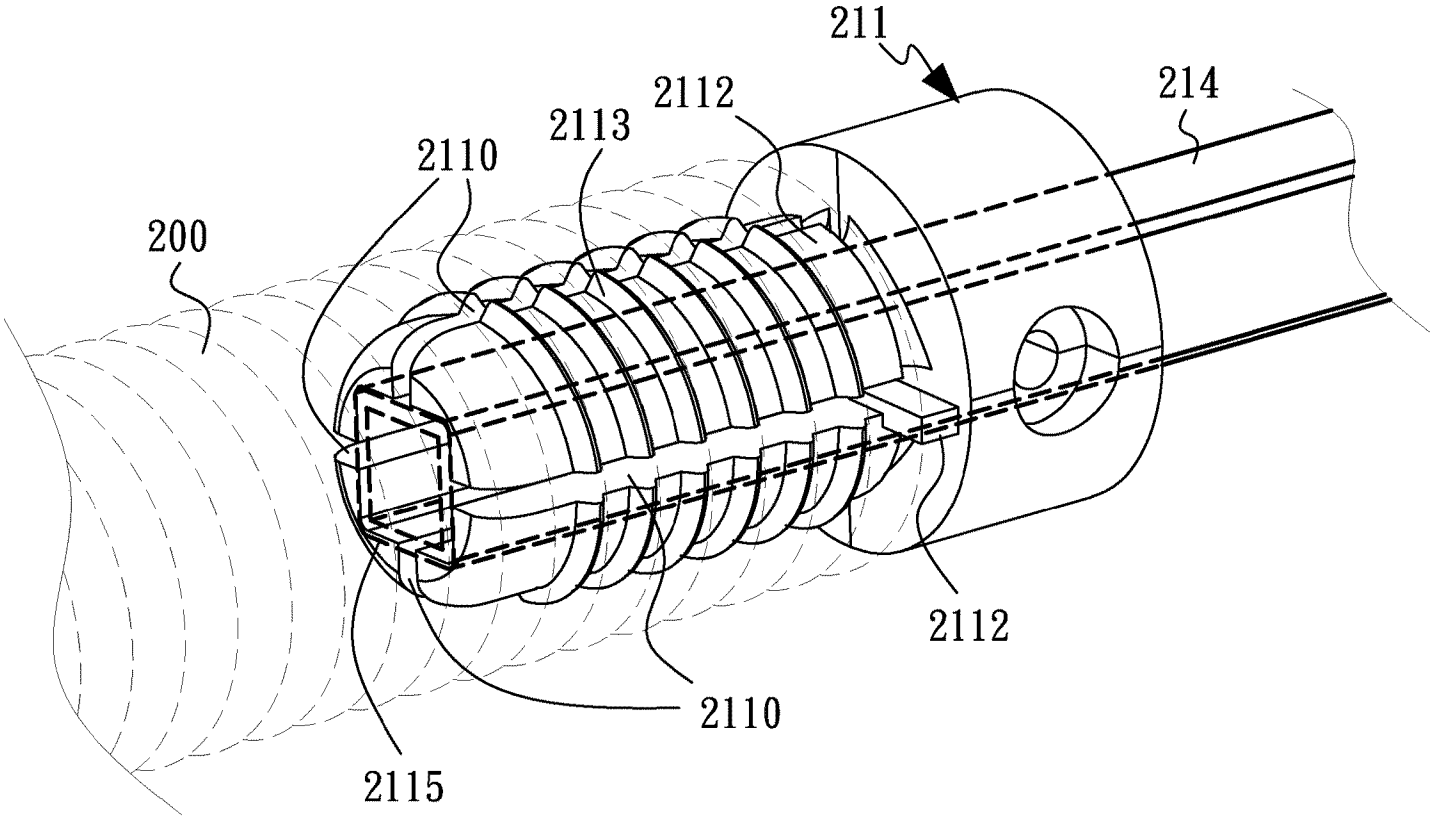
FIG. 12 is a partially enlarged view showing the assembly of parts the multifunction trainer according to the second embodiment of the present invention.

FIG. 12 is a partially enlarged view showing the assembly of spring 200 and the threaded part 211 of the multifunction trainer 2 according to the second embodiment of the present invention. Referring to FIG. 12, the thread 2113 of the threaded part 211 is screwed into one end of the spring 200 and the thread 2113 is stopped by the stop protrusion 2112 when the spring 200 contacts the stop protrusion 2112. After that, a fitting part 214 is inserted into the room 2115 of the thread part 211, and the fitting part 214 can make the cuttings 2110 to be fully spread. In this embodiment, the fitting part has a square solid or hollowed configuration. In this embodiment, the fitting part 214 is made of metal.

Referring to FIG. 12, an important feature of the present invention is that after the fitting part 214 is inserted into the room 2115 of the threaded part 211 to spread the cuttings 2110, the outer diameter of the thread 2113 of the threaded part 211 becomes uncompressible and fixed such that the thread 2113 of the threaded part 211 cannot be screwed out from the spring 200. At this time, if a force is exerted to screw the thread 2113 of threaded part 211 in a direction out of the spring 200, then the internal diameter of the spring 200 will become smaller than the original internal diameter of the spring 200 due to a counter torque force of the spring 200, such that the thread 2113 of threaded part 211 is tightly engaged by the spring 200 and therefore the thread 2113 of the threaded part 211 cannot be screwed out of the spring 200.

Referring to FIGS. 8, 9, and 12, the fitting part 214 further passes through a square hole 2120 of the base tube 212, which is inserted within the handle 213. In addition, the two big rollers 215 are respectively arranged at a left side and a right side of the handle 213, and the fitting part 214 passes through a square hole 2160 of the two connecting plates arranged at the left side and the right side of each big roller 215. Further, the fitting part 214 passes through a square hole 2100 of a terminal tube 210. In addition, a first fixing component 2180, such as a C-shaped plug, is used to connect a hole 2182 of the hook 218, a hole 2102 of the terminal tube 210, and a hole 2140 of the fitting part 214. Further, a second fixing component 2116, such as a screw, is used to connect a hole 2114 of the threaded part 211 and a hole 2142 of the fitting part 214.

Referring to FIGS. 8, 9, and 12, moreover, a lower end of each connecting plate 216 includes a slot 2162 and an axle (not shown) of one corresponding small roller 217 is arranged within the slot 2162. Therefore, the axle of the small roller 217 can be moved forward and backward within the slot 2162. FIG. 7 is a perspective view showing the assembled multifunction trainer 2. When the multifunction trainer 2 is operated in a direction that the big roller 215 is in front of the small roller 217, the axle of the small roller 217 will move to the end of the slot 2162 far from the big roller 215, such that the big roller 215 and the small roller 217 keep remote and the small roller 217 will not hinder the rotation of the big roller 215. When the multifunction trainer 2 is operated in a direction that the small roller 217 is in front of the big roller 215, the axle of the small roller 217 will move to the end of the slot 2162 close to the big roller 215, such that the big roller 215 will touch the small roller 217 and the small roller 217 will stop the rotation of the big roller 215. In this embodiment, the fitting part 214 has a square configuration can keep all connecting plates 216 moving in a same orientation, resulting in smooth operation of the big roller 215 and the small roller 217.

Accordingly, the present invention provides the multifunction trainers 1/2 have simple mechanism and high reliability and are easy to assemble and convenient for maintenance.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A multifunction trainer, comprising:

a spring assembly comprising a spring;

two handle assemblies respectively arranged at a left side and a right side of the spring assembly, each of the handle assemblies comprising:

a threaded part having a shell and a room within the shell, wherein a surface of the shell includes a thread with one or more longitudinal cuttings, where the thread is configured to be screwed into a respective end of the spring; and a fitting part configured to tighten or loosen the thread of the threaded part and the spring, with respect to one another, by being placed into or drawn out of the room of the shell of the threaded part, so as to make an outer diameter of the thread non-compressible or compressible due to the one or more longitudinal cuttings.

2. The multifunction trainer as recited in claim 1, wherein the fitting part has a square column configuration.

3. The multifunction trainer as recited in claim 2, wherein each of the handle assemblies further comprises a base tube and a handle, the fitting part passes through a square hole of the base tube, where the base tube is arranged within the handle.

4. The multifunction trainer as recited in claim 3, wherein each of the handle assemblies further comprises two big rollers respectively arranged at a left side and a right side of the handle, and two connecting plates are respectively arranged at a left side and a right side of each of the big rollers, and wherein the fitting part passes through a square hole of each of the connecting plates and passes through a square hole of an inner tube of each of the big rollers.

5. The multifunction trainer as recited in claim 1, wherein the fitting part has a cylinder configuration.

6. The multifunction trainer as recited in claim 5, wherein each of the handle assemblies further comprises a base tube and a handle, a bottom end of the threaded part couples a front end of the base tube, and the base tube is arranged within the handle.

7. The multifunction trainer as recited in claim 1, wherein the threaded part is made of plastics or rubber.

8. The multifunction trainer as recited in claim 1, wherein the outer diameter of the thread of a surface of the shell is equal to or greater than an internal diameter of the spring.

9. The multifunction trainer as recited in claim 1, wherein the fitting part is made of metal.

10. The multifunction trainer as recited in claim 1, wherein the thread of a surface of the shell further includes a stop protrusion to stop the thread to be screwed into the spring, where when the spring contacts the stop protrusion, the thread will be stopped and cannot be screwed further.

* * * * *